US011619026B2

(12) United States Patent
Fulcher et al.

(10) Patent No.: US 11,619,026 B2
(45) Date of Patent: Apr. 4, 2023

(54) MOTOR GRADER SUSPENDED MASS RIDE CONTROL

(71) Applicant: Caterpillar Inc., Peoria, IL (US)

(72) Inventors: Richard Lane Fulcher, Peoria, IL (US); Timothy A. Evans, Washington, IL (US); Travis N. Richards, Chillicothe, IL (US); Yongtao Li, Urbana, IL (US)

(73) Assignee: Caterpillar Inc., Peoria, IL (US)

( * ) Notice: Subject to any disclaimer, the term of this patent is extended or adjusted under 35 U.S.C. 154(b) by 854 days.

(21) Appl. No.: 16/591,034

(22) Filed: Oct. 2, 2019

(65) Prior Publication Data

US 2021/0102358 A1 Apr. 8, 2021

(51) Int. Cl.
*E02F 9/22* (2006.01)
*E02F 3/76* (2006.01)

(52) U.S. Cl.
CPC ..... *E02F 9/2257* (2013.01); *E02F 3/7668* (2013.01)

(58) Field of Classification Search
CPC ..... E02F 9/2217; E02F 9/2203; E02F 9/2257; E02F 3/7668; E02F 3/652; B60G 2300/09
See application file for complete search history.

(56) References Cited

U.S. PATENT DOCUMENTS 5,520,499 A * 5/1996 Ufheil ..... E02F 9/2207 60/413
5,706,657 A * 1/1998 Amborski ..... E02F 9/2217 60/413
5,733,095 A * 3/1998 Palmer ..... E02F 9/2217 60/413
7,194,856 B2 * 3/2007 Ma ..... E02F 9/2207 60/418
7,621,124 B2 * 11/2009 Mizoguchi ..... E02F 9/2207 60/469
7,793,740 B2 * 9/2010 Thomson ..... E02F 5/32 172/795
8,387,378 B2 * 3/2013 Payne ..... F15B 1/021 91/35
9,255,380 B2 2/2016 Ault
9,464,684 B2 * 10/2016 Contratto ..... F16F 15/06
(Continued)

FOREIGN PATENT DOCUMENTS

JP 08270001 A * 10/1996 ..... E02F 9/2217
WO WO-2018147096 A1 * 8/2018 ..... E02F 3/76

*Primary Examiner* — Jessica H Lutz
(74) *Attorney, Agent, or Firm* — von Briesen & Roper, s.c.

(57) ABSTRACT

A motor grader having ride control for dampening machine bounce using a DCM assembly rotatably coupled to and suspended from a frame of the motor grader is disclosed. Each lift cylinder for the DCM may have an associated ride control circuit with an accumulator, a ride control conduit fluidly connected to a carry end of the lift cylinder and having a flow restriction element, and a ride control accumulator valve fluidly connected to the accumulator and the ride control conduit and operable to either block or allow fluid communication between the carry end and the accumulator through the flow restriction element. Each rid control circuit may also include a head end valve fluidly connected to between the head end of the lift cylinder and a low pressure fluid reservoir and operable to block or allow fluid communication between the head end and the low pressure fluid reservoir.

20 Claims, 4 Drawing Sheets

(56) References Cited

U.S. PATENT DOCUMENTS

| | | | | |
|---|---|---|---|---|
| 10,030,364 | B2 * | 7/2018 | Rosa Neto | E02F 9/26 |
| 11,377,815 | B2 * | 7/2022 | Yamashita | E02F 9/2203 |
| 11,408,144 | B2 * | 8/2022 | Zell | E02F 9/205 |
| 2010/0108336 | A1 * | 5/2010 | Thomson | E02F 9/2207 172/795 |
| 2013/0158817 | A1 * | 6/2013 | Kingdon | E02F 3/6481 701/50 |
| 2013/0299266 | A1 * | 11/2013 | Ho | E02F 9/2217 180/271 |
| 2017/0114525 | A1 * | 4/2017 | Rosa Neto | E02F 9/0883 |
| 2017/0284067 | A1 * | 10/2017 | Tevis | E02F 3/764 |
| 2018/0320340 | A1 | 11/2018 | Evans | |

* cited by examiner

MOTOR GRADER SUSPENDED MASS RIDE CONTROL

TECHNICAL FIELD

The present disclosure relates generally to motor graders and, more particularly, to ride control for damping machine bounce using drawbar-circle-moldboard (DCM) assemblies of motor graders to counteract the machine bounce.

BACKGROUND

Machines that include weighted front-end and rear-end attachments, such as wheel loaders including a loaded bucket and backhoe loaders including a loaded bucket in front and a backhoe hanging from a boom at the rear, may bounce or lope as a result of the moment created by the loads as the machine encounters rough terrain or other obstacles. Bounce typically occurs at one or more given speeds based upon the machine, the tires, the attachments to the machine and the work surface over which the machine travels. In order to help reduce or eliminate this bounce, accumulators have been selectively connected to the lift actuators coupled to the loaded attachment. With the accumulator connected to the loaded end of the lift actuators, flow between the lift actuator and the accumulator allows the loaded attachment to move relative to a frame of the machine and dampen the bounce of the machine. Exemplary arrangements are disclosed in U.S. Pat. Nos. 5,733,095 and 7,793,740, which are also assigned to the assignee of the present disclosure.

Motor graders typically include an elongated frame assembly with at least two sets of wheels that are widely spaced from one another and a DCM assembly disposed between the sets of wheels and suspended from the frame by lift cylinders. Variations in motor grader designs include, for example, machines having two closely disposed pairs of rear wheels from which a front pair of wheels is spaced, and machines that have articulated front and rear frame assemblies. Inasmuch as motor graders generally do not haul cantilevered loads, such machine bounce does not typically develop in the same manner as a wheel loader, for example. Machine bounce can develop, however, as a result of the elongated structure and widely spaced wheelbase of the motor grader and tire sidewall flexing, as well as from undulations, potholes, bumps, washboard intersections, surface changes and other inconsistencies in the work surface over which the machine is traveling that can excite the machine into bouncing.

SUMMARY OF THE DISCLOSURE

In one aspect of the present disclosure, a motor grader having ride control for dampening machine bounce using a DCM assembly rotatably coupled to and suspended from a frame of the motor grader is disclosed. The motor grader may include a first lift cylinder having a first head end connected to the frame and a first carry end connected to a first side of the DCM assembly, a second lift cylinder having a second head end connected to the frame and a second carry end connected to a second side of the DCM assembly, a first directional control circuit fluidly connected to the first head end and the first carry end of the first lift cylinder and operable to selectively place the first head end and the first carry end in fluid communication with a high pressure fluid conduit and a drain conduit to extend the first lift cylinder and lower the first side of the DCM assembly, to retract the first lift cylinder and raise the first side of the DCM assembly, and to maintain the first lift cylinder in a first fixed position, and a second directional control circuit fluidly connected to the second head end and the second carry end of the second lift cylinder and operable to selectively place the second head end and the second carry end in fluid communication with the high pressure fluid conduit and the drain conduit to extend the second lift cylinder and lower the second side of the DCM assembly, to retract the second lift cylinder and raise the second side of the DCM assembly, and to maintain the second lift cylinder in a second fixed position. The motor grader may further include a first accumulator, a second accumulator, a first ride control conduit fluidly connected to the first carry end and having a first flow restriction element, a second ride control conduit flow restriction element fluidly connected to the second carry end and having a second flow restriction element, a first ride control accumulator valve fluidly connected to the first accumulator and the first ride control conduit and being operable to either block or allow fluid communication between the first carry end and the first accumulator through the first flow restriction element, and a second ride control accumulator valve fluidly connected to the second accumulator and the second ride control conduit and being operable to either block or allow fluid communication between the second carry end and the second accumulator through the second flow restriction element.

In another aspect of the present disclosure, a method of damping machine bounce using a DCM assembly of a motor grader is disclosed. The DCM assembly may be rotatably coupled to and suspended from a frame of the motor grader, and the motor grader may include a first lift cylinder having a first head end connected to the frame and a first carry end connected to a first side of the DCM assembly, and a second lift cylinder having a second head end connected to the frame and a second carry end connected to a second side of the DCM assembly. The method may include installing a first ride control circuit to the first carry end of the first lift cylinder, the first ride control circuit having a first accumulator, a first ride control conduit fluidly connected to the first carry end and having a first flow restriction element, and a first ride control accumulator valve fluidly connected to the first accumulator and the first ride control conduit and being operable to either block or allow fluid communication between the first carry end and the first accumulator through the first flow restriction element, and installing a second ride control circuit to the second carry end of the second lift cylinder, the second ride control circuit having a second accumulator, a second ride control conduit fluidly connected to the second carry end and having a second flow restriction element, and a second ride control accumulator valve fluidly connected to the second accumulator and the second ride control conduit and being operable to either block or allow fluid communication between the second carry end and the second accumulator through the second flow restriction element. The method may further include detecting an occurrence of a ride control trigger event, and opening the first ride control accumulator valve to allow fluid communication between the first carry end and the first accumulator through the first flow restriction element, and opening the second ride control accumulator valve to allow fluid communication between the second carry end and the second accumulator through the second flow restriction element, in response to detecting the occurrence of the ride control trigger event.

In a further aspect of the present disclosure, a motor grader having ride control for dampening machine bounce using a DCM assembly rotatably coupled to and suspended from a frame of the motor grader is disclosed. The motor grader may include a first lift cylinder having a first head end connected to the frame and a first carry end connected to a first side of the DCM assembly, a first directional control circuit fluidly connected to the first head end and the first carry end of the first lift cylinder and operable to selectively place the first head end and the first carry end in fluid communication with a high pressure fluid conduit and a drain conduit to extend the first lift cylinder and lower the first side of the DCM assembly, to retract the first lift cylinder and raise the first side of the DCM assembly, and to maintain the first lift cylinder in a fixed position. The motor grader may further include a first accumulator, a first ride control conduit fluidly connected to the first carry end and having a first flow restriction element, a first ride control accumulator valve fluidly connected to the first accumulator and the first ride control conduit and being operable to either block or allow fluid communication between the first carry end and the first accumulator through the first flow restriction element, and a controller operatively connected to the first directional control circuit and the first ride control accumulator valve. The controller being programmed to detect an occurrence of a ride control trigger event, and, in response to detecting the occurrence of the ride control trigger event, transmit ride control signals to the first ride control accumulator valve to cause the first ride control accumulator valve to open to allow fluid communication between the first carry end and the first accumulator through the first flow restriction element.

Additional aspects are defined by the claims of this patent.

DETAILED DESCRIPTION

Figure 1:
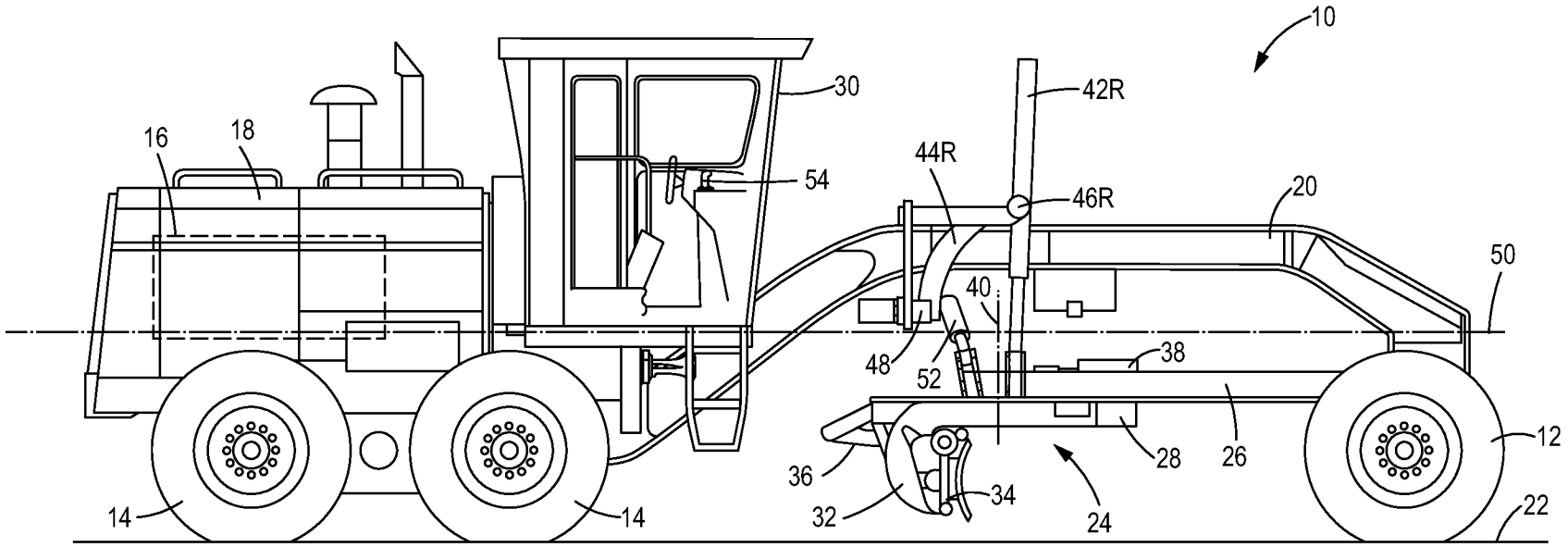
FIG. 1 is a side view of a motor grader in which ride control in accordance with the present disclosure may be implemented.
Figure 2:
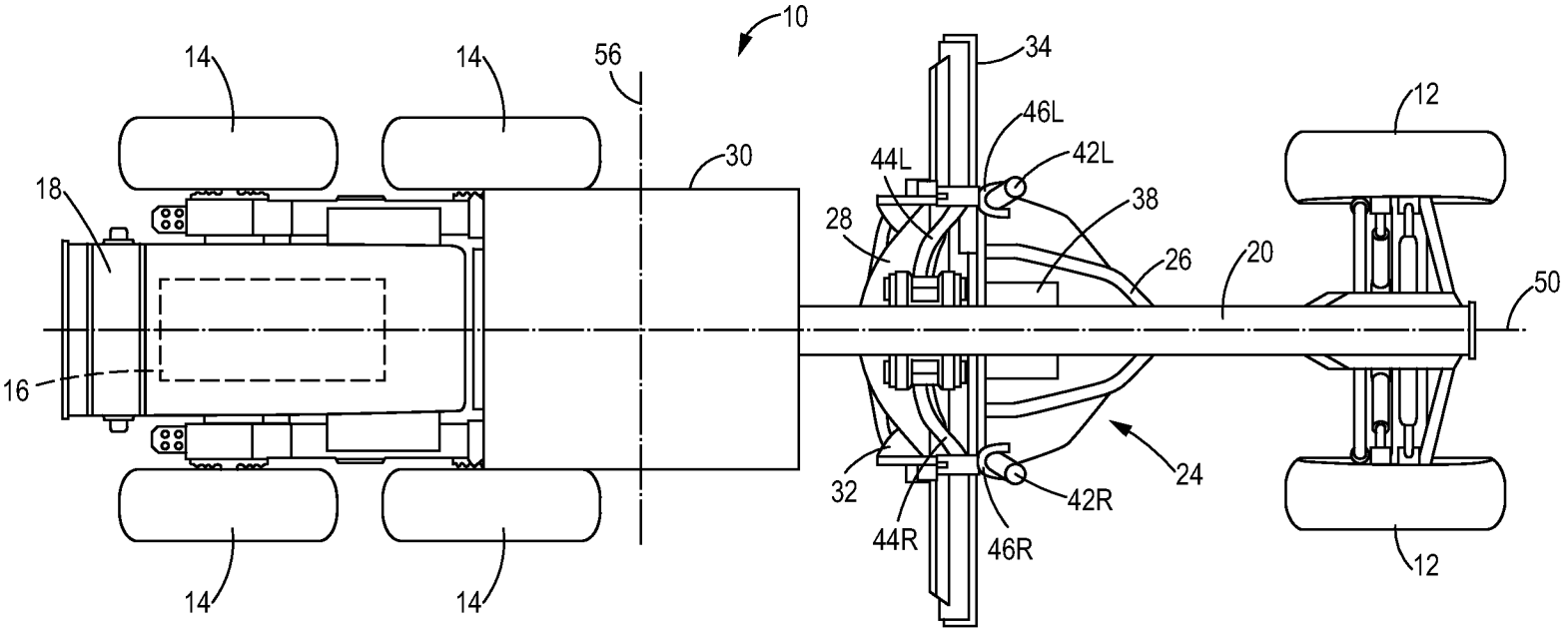
FIG. 2 is a top view of the motor grader of FIG. 1.

An exemplary embodiment of a motor grader 10 in which a ride control in accordance with the present disclosure may be implemented is illustrated in FIGS. 1 and 2. The illustrated motor grader 10 may include steerable traction devices 12, driven traction devices 14, a power source 16 within a main body 18 of the motor grader 10 and supported by the driven traction devices 14, and a frame 20 connecting the steerable traction devices 12 to the main body 18. The steerable traction devices 12 and the driven traction devices 14 may include one or more wheels located on each side of the motor grader 10 (both sides shown in FIG. 2). The wheels may be rotatable and/or tiltable for use during steering and leveling of a work surface 22. Alternatively, the steerable traction devices 12 and/or the driven traction devices 14 may include tracks, belts, or other traction devices known in the art. Moreover, it is contemplated that ride control in accordance with the present disclosure may be implemented in rear wheel drive, front wheel drive and all-wheel drive motor graders 10.

The motor grader 10 as illustrated includes a work implement such as, for example, a DCM assembly 24 including a drawbar 26 that is supported by the frame 20 and a multi-dimensional rotational connector such as a ball and socket joint (not shown) located proximal the steerable traction devices 12. A circle 28 is mounted on the drawbar 26 at an end opposite the connection to the frame 20, and proximate the main body 18 and an operator station 30. A moldboard 32 is mounted to the circle 28, and a blade 34 is mounted to the moldboard 32 in manner that allows a pitch of the blade 34 to be controlled by extending and retracting a blade pitch cylinder 36. A circle rotation control device 38 is actuatable by an operator of the motor grader 10 to rotate the circle 28 and, correspondingly, the blade 34 about a vertical rotational axis 40.

The DCM assembly 24 is suspended from the frame 20 by a pair of lift cylinders 42R, 42L (left elements shown in FIG. 2) that are operable to control the vertical position and the roll of the blade 34 with respect to the main body 18 and the frame 20 of the motor grader 10 and the work surface 22. Each lift cylinder 42R, 42L is rotatably connected to a corresponding lift arm 44R, 44L by a yoke 46R, 46L that allows rotation of the lift cylinder 42R, 42L about two axes relative to the lift arm 44R, 44L. The lift arms 44R, 44L are in turn pivotally connected to the frame 20. A link bar 48 is pivotally connected to the lift arms 44R, 44L so that the frame 20, the lift arms 44R, 44L and the link bar 48 form a four-bar linkage having joints with rotational axes that are parallel to a longitudinal axis 50 of the motor grader 10. The link bar 48 may be configured to be positioned and locked in place relative to the frame 20 at any one of a plurality of discrete positions to maintain the four-bar linkage in a desired position as the motor grader 10 is operated to perform work operations on the work surface 22. With the link bar 48 locked in place, a center shift cylinder 52 can be extended and retracted to shift the DCM assembly 24 from side-to-side to position the blade 34.

Ends of the lift cylinders 42R, 42L are rotatably connected to the drawbar 26 by corresponding ball and socket joints (not shown). The rotational freedom provided by the yokes 46R, 46L and the ball and socket joints allow the lift cylinders 42R, 42L to be extended and retracted together or independently to adjust both the vertical position and the roll of the blade 34. The blade 34 can be raised or lowered relative to the main body 18 and the frame 20 without changing the roll of the blade 34 by extending or retracting the lift cylinders 42R, 42L at rates that maintain the blade 34 at a constant rotational position about the longitudinal axis 50 of the motor grader 10. The blade 34 can also be rotated about the longitudinal axis 50 as viewed from the operator station 30 in either direction by extending and retracting the lift cylinders 42R, 42L at different times and at different rates to achieve a desired roll of the blade 34. The operation of the lift cylinders 42R, 42L to change the vertical position and the roll of the blade 34 can be manually controlled by the operator by manipulating implement position input devices 54, such as manual levers, joysticks or other types of input devices, provided for the operator in the operator station 30.

Figure 3:
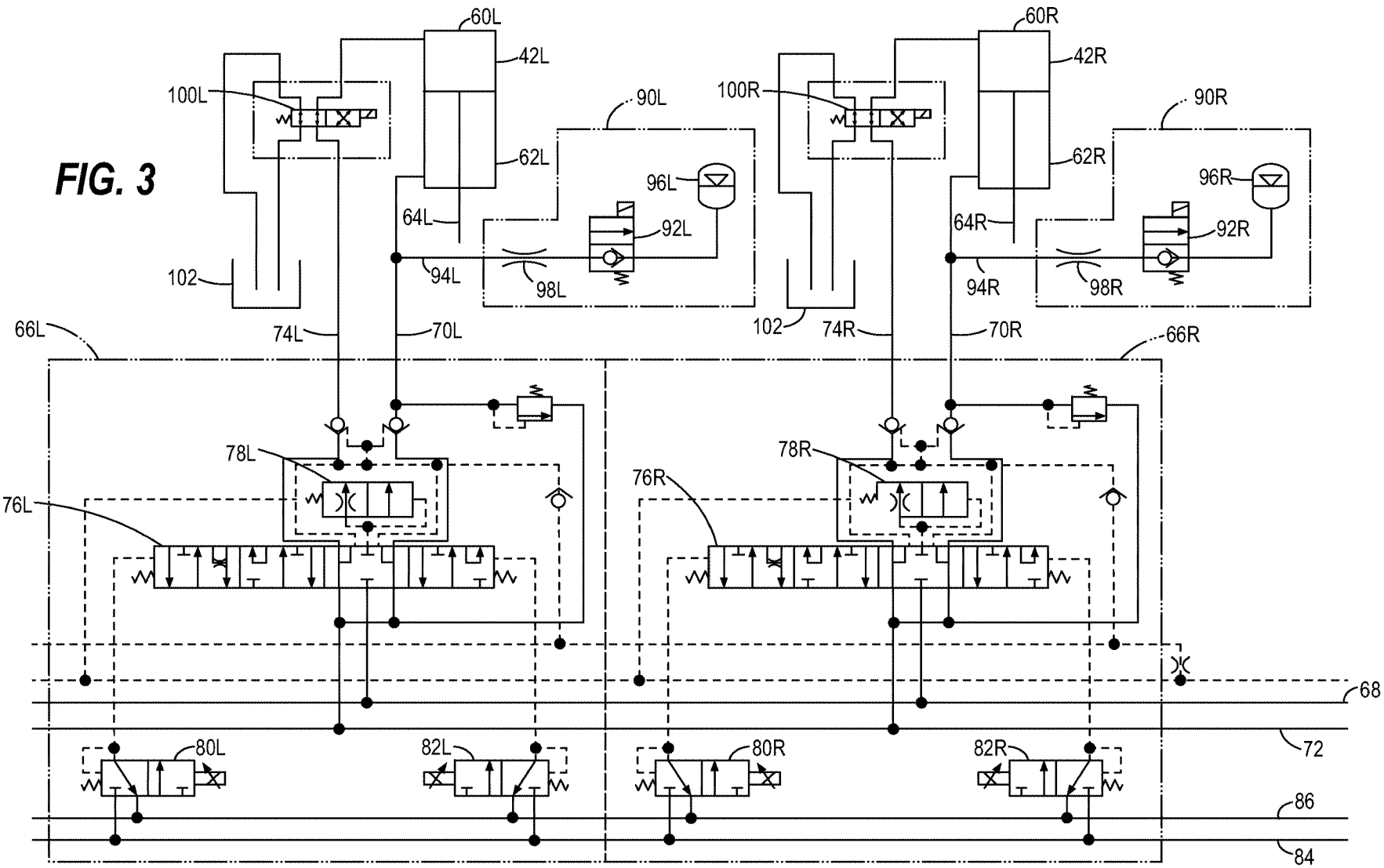
FIG. 3 is a schematic diagram of portion of a hydraulic system for controlling the operation of lift cylinders of the motor grader of FIGS. 1 and 2 and incorporating ride control in accordance with the present disclosure.

FIG. 3 illustrates a portion of a hydraulic system of the motor grader 10 that controls the operation of lift cylinders 42L, 42R including elements for implementing ride control of the motor grader of FIGS. 1 and 2 and incorporating ride control in accordance with the present disclosure. Each of the lift cylinders 42L, 42R is controlled independently by a similar configuration of hydraulic control elements. For clarity of description and recognition, the hydraulic control elements for the left lift cylinder 42L will be identified by reference numerals followed by the letter "L" and the corresponding hydraulic control elements for the right lift cylinder 42R will be identified by the same reference numerals followed the letter "R." The configuration and operation of the hydraulic control elements of the left lift cylinder 42L will be described in detail, and the corresponding hydraulic control elements of the right lift cylinder 42R, though not described with the same level of detail, are configured and operate in the same manner except as noted herein were applicable. Moreover, while the hydraulic control elements are referenced herein as "left" or "L" and "right" or "R" those skilled in the art will understand that reference to any element as a "first" element may apply to the element related to either of the lift cylinders 42L, 42R, and a corresponding reference to a "second" element will apply the element related to the other of the lift cylinders 42L, 42R.

The lift cylinder 42L has ahead end 60L and a rod or carry end 62L with a cylinder rod 64L extending therefrom. An end of the cylinder rod 64L is connected to a left side of the DCM assembly 24 to support a portion of the weight of the DCM assembly 24. Extension and retraction of the lift cylinder 42L are controlled by a directional control circuit 66L. The directional control circuit 66L operates to fluidly connect a high pressure fluid conduit 68 to a carry end conduit 70L and to fluidly connect a drain conduit 72 to a head end conduit 74L to retract the lift cylinder 42L and raise the corresponding portion of the DCM assembly 24, to fluidly connect the conduits 68, 72 to the conduits 70L, 74L, respectively, to extend the lift cylinder 42L and lower the corresponding portion of the DCM assembly 24, or to cut off the conduits 70L, 74L from the conduits 68, 72 to hold the lift cylinder 42L in a given position. The high pressure fluid conduit 68 may be fluidly connected to a pressurized fluid source such as a pump (not shown) and the drain conduit 72 may be fluidly connected to a low pressure fluid reservoir.

Among other elements, the directional control circuit 66L may include a directional control valve 76L, a pressure regulator valve 78L, a first pilot valve 80L and a second pilot valve 82L. The pilot valves 80L, 82L may be fluidly connected to a pilot fluid supply conduit 84, a pilot fluid drain conduit 86, and to opposite ends of the directional control valve 76L. The pilot valves 80L, 82L may be solenoid operated and controllable to transmit pilot signals to the ends of the directional control valve 76L to move the directional control valve 76L to its various positions in a manner known in the art. In alternative arrangements, the pilot valves 80L, 82L may be omitted, and the directional control valve 76L may be solenoid operated in both directions to move between its positions. As a further alternative, the pilot valves 80L, 82L may be omitted, and the implement position input device 54 for the left lift cylinder 42L may be coupled to the directional control valve 76L by a mechanical linkage that converts displacement of the implement position input device 54 into a corresponding movement of the directional control valve 76L to extend and retract the lift cylinder 42L as commanded by the operator.

Ride control may be implemented for the lift cylinder 42L via a ride control circuit 90L. The ride control circuit 90L of the illustrated embodiment includes a ride control accumulator valve 92L fluidly connected to the carry end conduit 70L, and correspondingly the carry end 62L, by a ride control conduit 94L. The ride control accumulator valve 92L is also fluidly connected to an accumulator 96L. The ride control accumulator valve 92L as illustrated is spring biased toward a normal closed position as shown, and is solenoid operated to move to an open ride control position to place the carry end 62L of the lift cylinder 42L in fluid communication with the accumulator 96L. A flow restriction element of the ride control circuit 90L in the form of a ride control orifice 98L is positioned between the carry end conduit 70L and the ride control accumulator valve 92L along the ride control conduit 94L. As discussed further below, the ride control orifice 98L restricts the fluid flow from the carry end 62L to the accumulator 96L and vice versa to dissipate energy by turning kinetic energy of the flowing fluid into heat.

Solenoid actuation of the ride control accumulator valve 92L is exemplary, and the ride control accumulator valve 92L may be moved between the close position and the ride control position by any appropriate mechanism. For example, the ride control accumulator valve 92L may be pilot operated and controlled by a pilot signal from a pilot valve controlled by the controller 110 that may be similar to the pilot valves 80L, 82L. Alternatively, the solenoid may be connected to an electrical power source such as a battery of the motor grader 10 via a ride control activation switch that is toggled on and off when the motor grader 10 enters and exits the ride control mode. Further, the ride control accumulator valve 92L may be connected via a mechanical linkage to a ride control activation lever in the operator station 30 that is displaced by an operator to move the motor grader 10 into and out of the ride control mode.

The accumulator 96L may be pre-charged to a pressure that will ensure smooth transition into the ride control mode. A pre-charge pressure of the accumulator 96L may be less than a carry pressure of the lift cylinder 42L created by supporting the weight of the DCM assembly 24. The carry pressure may vary by implementation based on the weight of the DCM assembly 24 and the effective area of the carry end 62L of the lift cylinder 42L, among other factors. At the same time, the pre-charge pressure may be high enough to ensure that the lift cylinder 42L does not bottom out and the ride control circuit 90L loses the ride control cushion when the ride control accumulator valve 92L moves to the ride control position and the pressures in the carry end 62L and the accumulator 96L equalize.

While the ride control circuit 90L in accordance with the present disclosure is illustrated and described as including the ride control accumulator valve 92L, the accumulator 96L and the ride control orifice 98L, those skilled in the art will understand that the ride control circuit 90L may have additional elements. Such additional elements may include additional accumulators 90L that are selectively placed in fluid communication with the carry end 62L to assist with ride control. Further, the ride control circuit 90L may include additional valves performing other fluid flow functions between elements within the ride control circuit 90L and with other flow control elements of the motor grader 10. In one embodiment, the ride control circuit 90L may also have a balancing spool valve that is operable to balance the pressures between the carry end 62L and the accumulator 96L prior to initiating ride control to prevent sudden movement of the DCM assembly 24 that can introduce machine bounce. If the pressures are significantly out of balance, the lift cylinder 42L may rapidly extend or retract when the ride control accumulator valve 92L opens and fluid flows between the carry end 62L and the accumulator 96L to balance their pressures. The balancing spool valve may ensure smooth transitions into the ride control mode with minimal movement of the DCM assembly 24. Further additional flow control elements in the ride control circuit are contemplated by the inventors.

The ride control orifice 98L is exemplary of the flow restriction element that may be used in the ride control circuit 90L to restrict the fluid flow between the carry end 62L and the accumulator 96L. Those skilled in the art will understand that other passive and active flow control elements may be implemented in the ride control circuit 90L. For example, the ride control orifice 98L may be a variable orifice with an adjustable orifice area so that the amount of restriction can be varied to meet the flow restriction needs of a particular implementation. In other embodiments, the ride control orifice 98L may be replaced in the ride control conduit 94L by a ride control restrictor valve that is opened along with the ride control accumulator valve 92 when ride control is actuated. The ride control restrictor valve may be a spool valve that is solenoid actuated, pilot actuated via a connection to a pilot valve similar to the pilot valves 80L, 82L, or mechanically actuated via a linkage operatively connecting the ride control restrictor valve to a ride control activation lever in the operator station 30. In still further embodiments, the ride control orifice 98L may be integrated into the ride control accumulator valve 92L to reduce the number of fluid control elements in the ride control circuit 90L. Further alternative flow restriction elements that may be implemented in the ride control circuit 90L in accordance with the present disclosure will be apparent to those skilled in the art and are contemplated by the inventors.

Generally, the directional control valve 76L is in the illustrated position with the conduits 70L, 74L cut off from the conduits 68, 72 to prevent fluid flow to and from the cylinder ends 60L 62L when the ride control circuit 90L is actuated. However, the ride control circuit 90L will allow fluid to flow into and out of the carry end 62L of the lift cylinder 42L as the DCM assembly 24 moves up and down. If fluid flow for the head end 60L is blocked, the head end 60L will resist upward and downward movement of the cylinder rod 64L as the fluid is compressing and voiding, respectively, during upward and downward movement of the DCM 24. To alleviate these issues, the ride control circuit 90L may further include a head end valve 100L installed to alternately connect the head end 60L to the directional control circuit 66L and a low pressure fluid reservoir or tank 102. The head end valve 100L is spring biased toward a normal position wherein the head end 60L is in fluid communication with the directional control circuit 66L. The head end valve 100L is also solenoid operated to cause the head end valve 100L to move to a ride control position where the head end 60L is placed in fluid communication with the lower pressure fluid reservoir 102. Ideally, the head end valve 100L is actuated to its ride control position when the ride control accumulator valve 92L is actuated to its ride control position. When the head end valve 100L is in the ride control position, the head end 60L can drain fluid to the low pressure fluid reservoir 102 when the DCM assembly 24 moves upward to avoid resisting the movement, and can draw fluid from the low pressure fluid reservoir 102 when the DCM assembly 24 moves downward to prevent voiding within the head end 60L.

Solenoid actuation of the head end valve 100L is exemplary, and the head end valve 100L may be moved between the close position and the ride control position by any appropriate mechanism. For example, the head end valve 100L may be pilot operated and controlled by a pilot signal from a pilot valve that may be similar to the pilot valves 80L, 82L. Alternatively, the solenoid may be connected to an electrical power source such as a battery of the motor grader 10 via a ride control activation switch that is toggled on and off when the motor grader 10 enters and exits the ride control mode. Further, the head end valve 100L may be connected via a mechanical linkage to a ride control activation lever in the operator station 30 that is displaced by an operator to move the motor grader 10 into and out of the ride control mode.

The implementation of the head end valve 100L is exemplary and alternative mechanisms may be implemented to alternately disconnect and connect the head end 60L to the low pressure fluid reservoir 102. For example, in one alternative implementation, the head end conduit 74L may directly connect the head end 60L to the directional control circuit 66L with an intervening head end valve. A head end valve similar to the ride control accumulator valve 92L may be installed along a conduit that fluidly connects the head end conduit 74L and the low pressure fluid reservoir 102, and may be opened to fluidly connect the head end 60L to the low pressure fluid reservoir 102 when the ride control mode is activated. Further alternative implementations are contemplated.

While the ride control accumulator valve 92L and the head end valve 100L are illustrated and described herein as being separate valves with separate actuation mechanisms, those skilled in the art will understand that the valves 92L, 100L may be integrate in operation and structure. For example, the ride control accumulator valve 92L and the head end valve 100L may have common electromechanical or mechanical actuation mechanism that causes the valves 92L, 100L to move between the closed positions and the ride control positions simultaneously. In other embodiments, the ride control accumulator valve 92L and the head end valve 100L may be implemented in a single two-position valve having a closed position where the carry end 62L is blocked from the accumulator 96L and the head end 64L is blocked from the low pressure fluid reservoir 102, and a ride control position where the carry end 62L is fluidly connected to the accumulator 96L and the head end 64L is fluidly connected to the low pressure fluid reservoir 102. Further alternative combinations of the valves 92L, 100L are contemplated.

As discussed above, the right lift cylinder 42R has similar hydraulic control elements as the left lift cylinder 42L. The lift cylinder 42R has a head end 60R, a rod or carry end 62R and a rod 64R connected to the right side of the DCM assembly 24. A directional control circuit 66R includes a directional control valve 76R, and pressure regulator valve 78R and pilot valves 80R, 82R controlling the flow of fluid between conduits 70R, 74R and conduits 68, 72. A ride control conduit 94R with a ride control orifice 98R connects the carry end 62R via the carry end conduit 70R to a ride control circuit 90R having a ride control accumulator valve 92R and an accumulator 96R. A head end valve 100R alternately connects the head end 60R to the head end conduit 74R and the low pressure fluid reservoir 102.

Figure 4:
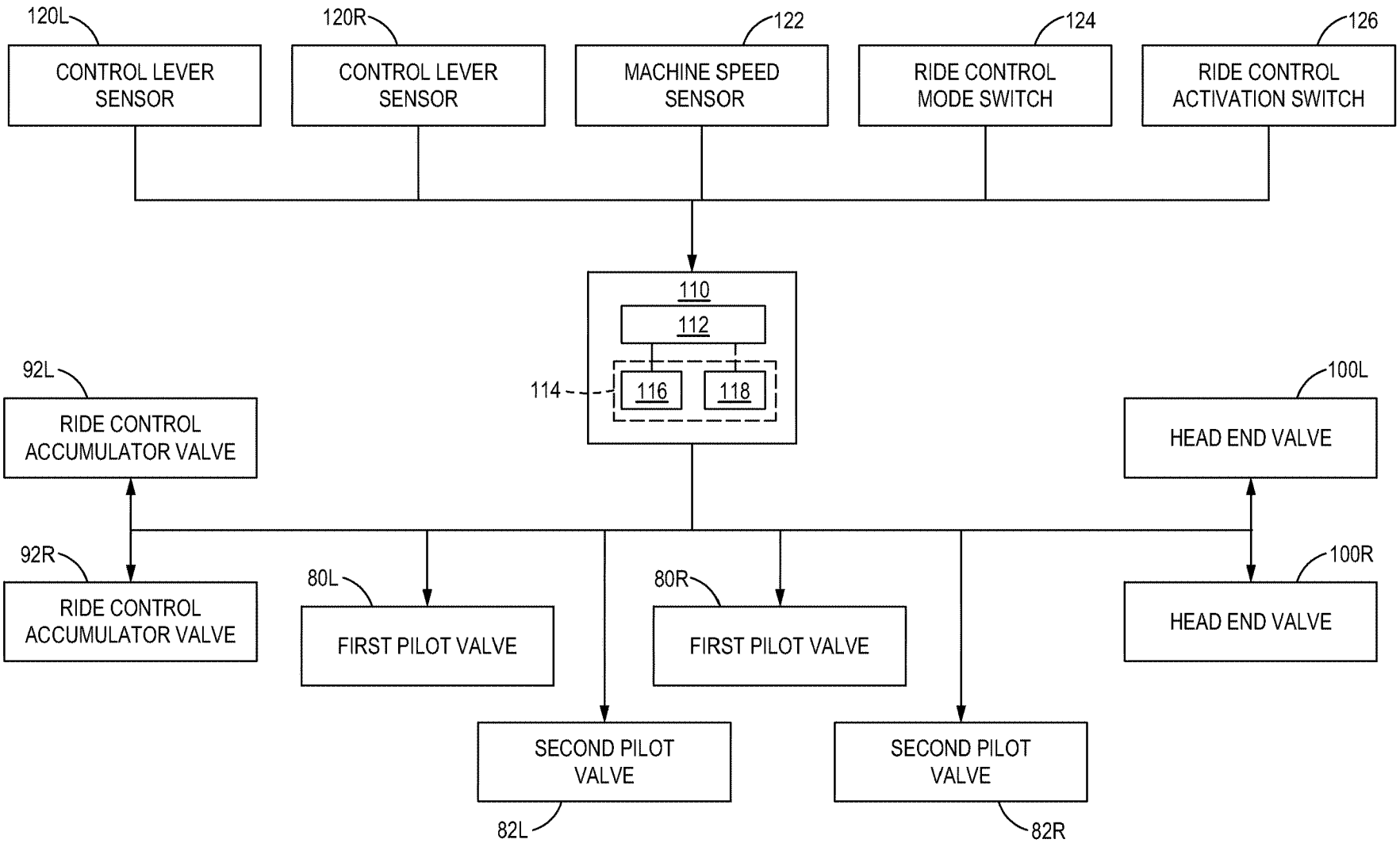
FIG. 4 is a block diagram of electrical and control components of the portion of the hydraulic system of FIG. 3.

FIG. 4 illustrates an exemplary arrangement of electrical and control components of the motor grader 10 that are capable of implementing ride control in accordance with the present disclosure for the lift cylinders 42L, 42R. A controller 110 may be capable of processing information received from monitoring and control devices using software stored at the controller 110, and outputting command and control signals to devices of the motor grader 10. The controller 110 may include a processor 112 for executing a specified program, which controls and monitors various functions associated with the motor grader 10. The processor 112 may be operatively connected to a memory 114 that may have a read only memory (ROM) 116 for storing programs, and a random access memory (RAM) 118 serving as a working memory area for use in executing a program stored in the ROM 116. Although the processor 112 is shown, it is also possible and contemplated to use other electronic components such as a microcontroller, an application specific integrated circuit (ASIC) chip, or any other integrated circuit device.

While the discussion provided herein relates to the functionality of the lift cylinders 42L, 42R including ride control, the controller 110 may be configured to control other aspects of operation of other systems of the motor grader 10, including other hydraulic cylinders, propulsion, steering, breaking, and the like. Moreover, the controller 110 may refer collectively to multiple control and processing devices across which the functionality of the motor grader 10 may be distributed. Portions of the functionality of the motor grader 10 may be performed at a controller of a remote computing device (not shown) that is operatively connected to the controller 110 by a communication link, such as in an autonomous vehicle with functions control at a central command station. The controllers may be operatively connected to exchange information as necessary to control the operation of the motor grader 10. Other variations in consolidating and distributing the processing of the controller 110 as described herein are contemplated as having use in motor graders 10 implementing ride control in accordance with the present disclosure.

The controller 110 may be operatively coupled to various input devices providing control signals to the controller 110 for the operation of the lift cylinders 42L, 42R and the ride control circuits 90L, 90R. Control lever sensors 120L, 120R may detect displacements of manual levers, joysticks or other inputs devices (not shown) manipulated by an operator to cause the lift cylinders 42L, 42R, respectively, to operate to raise and lower the DCM assembly 24. The control lever sensors 120L, 120R may respond to the displacements by transmitting control lever sensor signals to the controller 110 having values corresponding to the displacements of the input devices. The controller 110 may respond to the control lever sensor signals by transmitting pilot valve control signals to the pilot valves 80L, 82L, 80R, 82R to operate the directional control circuits 66L, 66R to actuate the lift cylinders 42L, 42R as commanded.

As discussed below, some configurations of ride control strategies may be dependent on the speed at which the motor grader 10 is traveling over the work surface 22. Consequently, a machine speed sensor 122 may be operatively connected to the controller 110 and operative to sense the speed of the motor grader 10 relative to the work surface 22 and direct machine speed sensor signals representative of the sensed machine speed to the controller 110. Alternative ride control modes may be provided for engaging the ride control circuits 90L, 90R. For example, an automatic mode may allow the controller 110 to automatically engage the ride control circuits 90L, 90R in response to the motor grader 10 operating at specified operating conditions, such as when the motor grader 10 is traveling above a predetermined speed or the DCM assembly 24 is raised above a predetermined height above the work surface 22 indicating that the blade 34 is not grading the work surface 22. To engage the ride control mode, the controller 110 may transmit valve control signals to actuators of the pilot valves 80L, 82L, 80R, 82R to move the directional control valves 76L, 76R to the closed position, and to actuators of the ride control accumulator valves 92L, 92R to open the ride control accumulator valves 92L, 92R. Alternatively, a manual mode may allow an operator of the motor grader 10 to engage the ride control circuits 90L, 90R regardless of the operating conditions. A ride control mode switch 124 operatively connected to the controller 110 may be provided in the operator station 30 and transmit mode switch signals indicative of the one of the available ride control mode positions to which the operator has moved the ride control mode switch 124. In response to receiving the mode switch signals, the controller 110 may operate to implement the mode selected by the operator. Where the motor grader 10 is configured with a manual ride control mode, a ride control activation switch 126 may be operatively connected to the controller 110 and transmit ride control switch signals to the controller 110 when the operator moves the ride control activation switch 126 between on and off positions. In other manual ride control implementations discussed further below, the ride control activation switch 126 or a ride control actuation lever may bypass the controller 110 and be directly coupled electrically, electromechanically or mechanically to the ride control circuits 90L, 90R for activation of ride control in the motor grader 10.

INDUSTRIAL APPLICABILITY

As discussed above, machine bounce can develop on the motor grader 10 as it travels over the work surface 22 due to the elongated structure of the motor grader, wide spacing of the wheelbase, and flexing of tire sidewalls. The bouncing may not occur at low speeds, but can occur when the motor grader 10 exceeds a threshold speed. Bounce can also be caused by undulations, potholes, bumps, washboard intersections, surface changes and other inconsistencies in the work surface over which the machine is traveling that can excite the machine into bouncing. When the motor grader 10 is traveling around and between work sites with the DCM assembly 24 suspended above the work surface 22 and not grading the work surface 22, the directional control valves 76L, 76R are typically in the closed position to block fluid flow between the lift cylinders 42L, 42R and the high pressure fluid conduit 68 and the drain conduit 72 to hold the lift cylinders 42L, 42R and, correspondingly, the DCM assembly 24 in a fixed position relative to the frame 20. Without ride control, the DCM assembly 24 will move up and down with the frame 20 when the motor grader 10 begins to bounce.

The ride control strategy in accordance with the present disclosure can dampen the bouncing of the motor grader 10 by freeing the DCM assembly 24 to move relative to the frame 20 by allowing fluid flow into and out of the carry ends 62L, 62R of the lift cylinders 42L, 42R. By moving out of phase with the frame 20, the DCM assembly 24 counterbalances the movement of the frame 20 to smooth the ride of the motor grader 10 for the operator. When operating in the ride control mode, the controller 110 transmits ride control signals to cause the ride control accumulator valves 92L, 92R to move to their ride control positions and fluidly connect the carry ends 62L, 62R to the accumulators 96L, 96R. At the same time, ride control signals may cause the head end valves 100L, 100R to operate to fluidly connect the head ends 60L, 60R to the low pressure fluid reservoir 102. With the valves 92L, 92R, 100L, 100R in their ride control positions, the frame 20 can move without causing the same movement of the DCM assembly 24. When the frame 20 moves upward, and the head ends 60L, 60R of the lift cylinders 42L, 42R move upward with the frame 20, pressure in the carry ends 62L, 62R increases, but the ride control circuits 90L, 90R allow fluid to flow from the carry ends 62L, 62R to the accumulators 96L, 96R so that the frame 20 and the head ends 62L, 62R can move upward without pulling the cylinder rods 64L, 64R and the DCM assembly 24 upward at the same rate. At the same time, the volume of the head ends 60L, 60R increases, but the head end valves 100L, 100R allow fluid to be drawn into the head ends 60L, 60R from the low pressure fluid reservoir 102. When the frame 20 and the head ends 60L, 60R move downward at an acceleration rate faster than gravity, the carry ends 62L, 62R draw fluid from the accumulators 96L, 96R as their volumes increase while the head ends 60L, 60R discharge fluid to the low pressure fluid reservoir 102 so that the DCM assembly 24 drops at a slower rate.

If the ride control conduits 94L, 94R are relatively large, fluid may flow between the carry ends 62L, 62R and the accumulators 96L, 96R relatively freely. This may cause underdamped conditions that allow too much relative movement between the frame 20 and the DCM assembly 24. In view of this, flow restriction elements such as the ride control orifices 98L, 98R are implemented in the ride control conduits 94L, 94R to restrict the movement of the DCM assembly 24 without unduly restricting the fluid flow through the ride control circuits 90L, 90R. The ride control orifices 98L, 98R will function to convert kinetic energy of the flowing fluid into heat to dissipate energy input by the bouncing frame 20 to the lift cylinders 42L, 42R.

In exemplary embodiments, the ride control orifices 98L, 98R may have flow restriction element diameters with in a range from 2.0 mm to 4.0 mm. Flow restriction element diameters above this range may reduce energy dissipation and allow too much fluid flow and movement of the DCM assembly 24. Flow restriction element diameters below the range may choke the fluid flow to the point where the responsiveness of the ride control circuits 90L, 90R is too tight and movement of the DCM assembly 24 too closely follows the movement of the frame 20. In other embodiments, the flow restriction element diameters may be in the range of ±10% of 3.0 mm, or approximately equal to 3.0 mm such that the value of the flow restriction element diameter is within ±5% of 3.0 mm. However, these ranges are exemplary. Optimal sizing of the flow restriction element diameter, as well as sizes of the ride control accumulator valves 92L, 92R, the accumulators 96L, 96R and the head end valves 100L, 100R, may be dependent on a variety of factors, such as anticipated bounce in the motor grader 10, the weight of the DCM assembly 24, the size of the lift cylinders 42L, 42R and the like. Moreover, due to asymmetry of the DCM assembly 24 due at least to the positioning of the center shift cylinder 52, the lift cylinders 42L, 42R may be subjected to different loading such that the ride control circuits 90L, 90R in a given motor grader 10 may require different sizing such that the left ride control orifice 98L has a different flow restriction element diameter than the second ride control orifice 98R. In other embodiments, flexibility may be built into the ride control circuits 90L, 90R by implementing the ride control orifices 98L, 98R as variable orifices having variable flow restriction element diameters that can be tuned to the requirements for a particular implementation.

Actuation of the ride control circuits 90L, 90R to perform ride control may be triggered in a variety of ways and based on a variety of conditions. As discussed above, the motor grader 10 in accordance with the present disclosure may be provided with both automatic and manual modes of actuation of the ride control circuits 90L, 90R that may be selected by an operator of the motor grader 10 at the ride control mode switch 124. In the automatic mode, ride control may be initiated by a trigger event wherein the operating conditions of the motor grader 10 indicate that the motor grader 10 may experience bouncing such that ride control is necessary. For example, the speed of the motor grader 10 over the work surface 22 may dictate when ride control is engaged. The machine speed sensor 122 may be configured to detect the machine speed of the motor grader 10 over the work surface 22 and to transmit machine speed sensor signals to the controller 110 with a machine speed sensor value corresponding to a detected machine speed. Upon receiving the machine speed sensor signals, the controller 110 may compare the machine speed sensor value to a ride control threshold machine speed value. If the machine speed sensor value is greater than the ride control threshold machine speed value, the conditions trigger actuation of the ride control circuits 90L, 90R, and the controller 110 may transmit ride control signals to the ride control accumulator valves 92L, 92R and the head end valves 100L, 100R. Other operating parameters may be used in a similar manner to trigger ride control when the conditions dictate. For example, accelerometers on the frame 20 may measure the rate of vertical displacement of the frame 20 to determine when machine bouncing is occurring. In other embodiments, actuation of the ride control circuits 90L, 90R may be triggered base on the positioning of the DCM assembly 24 above the work surface 22 at a height where it is clear that the blade 34 is not being used to grade the work surface 22. The motor grader 10 may include a total blade position sensor or other sensors providing sensor signals to the controller 110 that are used by the controller 110 to determine the height of the DCM assembly 24 relative to the frame 20 or to the work surface 22. When the height of the DCM assembly 24 is greater than a predetermined minimum DCM height, the controller 110 may response by transmitting the ride control signals to the ride control accumulator valves 92L, 92R and the head end valves 100L, 100R. The controller 110 may keep ride control active until the conditions causing the triggering event are no longer present, such as when the machine speed drops below the ride control threshold machine speed value or the height of the DCM assembly 24 is below the minimum DCM height, or until another intervening event occurs such as the controller 110 detecting control lever sensor signals from the control lever sensors 120L, 120R indicating that the operator is operating the lift cylinders 42L, 42R to move the DCM assembly 24. In alternative implementations of the manual mode, processing by the controller 110 may be replaced by direct control of the ride control circuits 90L, 90R by the ride control activation inputs. For example, the ride control activation switch 126 may be operatively connected to the ride control circuits 90L, 90R and alternately connect and disconnect the solenoid actuators of the ride control accumulator switches 92L, 92R and the head end valves 100L, 100R to an electric power source to move the valves 92L, 92R, 100L, 100R between the ride control and closed positions. In other implementations, the valves 92L, 92R, 100L, 100R may be connected by mechanical linkages to a ride control activation lever in the operator station 30 that may cause the valves 92L, 92R, 100L, 100R to move to their ride control positions when the ride control activation lever is displace to a ride control activation position.

The manual ride control mode may allow an operator flexibility to use ride control even under conditions that would not normally trigger ride control under a particular set of operating conditions, or to turn off ride control where movement of the DCM assembly 24 with respect to the frame 20 is unacceptable or not desired. The ride control mode switch 124 may be moved to a manual mode position so that the controller 110 will not automatically trigger ride control. Instead, upon detection of the operator moving the ride control activation switch 126 to a ride control active position, the controller 110 transmits ride control signals to the ride control accumulator valves 92L, 92R and the head end valves 100L, 100R. The ride control circuits 90L, 90R may remain engaged until the controller 110 detects the ride control activation switch 126 being set to a ride control off position.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A motor grader having ride control for dampening machine bounce using a drawbar-circle-moldboard (DCM) assembly rotatably coupled to and suspended from a frame of the motor grader, the motor grader comprising:

a first lift cylinder having a first head end connected to the frame and a first carry end connected to a first side of the DCM assembly;

a second lift cylinder having a second head end connected to the frame and a second carry end connected to a second side of the DCM assembly;

a first directional control circuit fluidly connected to the first head end and the first carry end of the first lift cylinder and operable to selectively place the first head end and the first carry end in fluid communication with a high pressure fluid conduit and a drain conduit to extend the first lift cylinder and lower the first side of the DCM assembly, to retract the first lift cylinder and raise the first side of the DCM assembly, and to maintain the first lift cylinder in a first fixed position;

a second directional control circuit fluidly connected to the second head end and the second carry end of the second lift cylinder and operable to selectively place the second head end and the second carry end in fluid communication with the high pressure fluid conduit and the drain conduit to extend the second lift cylinder and lower the second side of the DCM assembly, to retract the second lift cylinder and raise the second side of the DCM assembly, and to maintain the second lift cylinder in a second fixed position;

a first accumulator;

a second accumulator;

a first ride control conduit fluidly connected to the first carry end and having a first flow restriction element;

a second ride control conduit fluidly connected to the second carry end and having a second flow restriction element;

a first ride control accumulator valve fluidly connected to the first accumulator and the first ride control conduit and being operable to either block or allow fluid communication between the first carry end and the first accumulator through the first flow restriction element; and a second ride control accumulator valve fluidly connected to the second accumulator and the second ride control conduit and being operable to either block or allow fluid communication between the second carry end and the second accumulator through the second flow restriction element.

2. The motor grader of claim 1, comprising a controller operatively connected to the first directional control circuit, the second directional control circuit, the first ride control accumulator valve and the second ride control accumulator valve, the controller being programmed to:

detect an occurrence of a ride control trigger event; and in response to detecting the occurrence of the ride control trigger event, transmit ride control signals to the first ride control accumulator valve and the second ride control accumulator valve to cause the first ride control accumulator valve to open to allow fluid communication between the first carry end and the first accumulator through the first flow restriction element, and to cause the second ride control accumulator valve to open to allow fluid communication between the second carry end and the second accumulator through the second flow restriction element.

3. The motor grader of claim 2, comprising a machine speed sensor operatively connected to the controller and configured to detect a machine speed of the motor grader over a work surface and to transmit machine speed sensor signals having a machine speed sensor value corresponding to a detected machine speed, wherein, to determine the occurrence of the ride control trigger event, the controller is programmed to:

compare the machine speed sensor value from the machine speed sensor to a ride control threshold machine speed value; and transmit the ride control signals in response to determining that the machine speed sensor value is greater than the ride control threshold machine speed value.

4. The motor grader of claim 2, comprising a ride control activation switch operatively connected to the controller and configured to detect input of an operator of the motor grader to select a ride control active position or a ride control off position of the ride control activation switch and to transmit ride control activation switch signals having a ride control activation switch value corresponding to a ride control actuation switch input by the operator, wherein, to determine the occurrence of the ride control trigger event, the controller is programmed to:

determine whether the ride control activation switch value corresponds to the ride control active position; and transmit the ride control signals in response to determining that the ride control activation switch value corresponds to the ride control active position.

5. The motor grader of claim 1, wherein the first flow restriction element and the second flow restriction element have a flow restriction element diameter that is within a range from 2.0 mm to 4.0 mm.

6. The motor grader of claim 1, wherein the first flow restriction element and the second flow restriction element have a flow restriction element diameter that is approximately 3.0 mm.

7. The motor grader of claim 1, wherein the first flow restriction element and the second flow restriction element have a flow restriction element diameter that is variable.

8. The motor grader of claim 1, comprising a ride control activation switch operatively connected to the first ride control accumulator valve and the second ride control accumulator valve and configured to detect input of an operator of the motor grader to select a ride control active position or a ride control off position of the ride control activation switch, wherein, in response to determining that the ride control activation switch is in the ride control active position, causes the first ride control accumulator valve to open to allow fluid communication between the first carry end and the first accumulator through the first flow restriction element, and causes the second ride control accumulator valve to open to allow fluid communication between the second carry end and the second accumulator through the second flow restriction element.

9. The motor grader of claim 1, comprising:

a first head end valve fluidly connected to the first head end, the first directional control circuit and a low pressure fluid reservoir, the first head end valve being operable to selectively fluidly connect the first head end to either the first directional control circuit or the low pressure fluid reservoir; and a second head end valve fluidly connected to the second head end, the second directional control circuit and the low pressure fluid reservoir, the second head end valve being operable to selectively fluidly connect the second head end to either the second directional control circuit or the low pressure fluid reservoir, wherein, when ride control is not active, the first head end valve is operated to fluidly connect the first head end to the first directional control circuit, and the second head end valve is operated to fluidly connect the second head end to the second directional control circuit, and wherein, when ride control is active, the first head end valve is operated to fluidly connect the first head end to the low pressure fluid reservoir, and the second head end valve is operated to fluidly connect the second head end to the low pressure fluid reservoir.

10. A method of damping machine bounce using a drawbar-circle-moldboard (DCM) assembly of a motor grader, wherein the DCM assembly is rotatably coupled to and suspended from a frame of the motor grader, and wherein the motor grader includes a first lift cylinder having a first head end connected to the frame and a first carry end connected to a first side of the DCM assembly, and a second lift cylinder having a second head end connected to the frame and a second carry end connected to a second side of the DCM assembly, comprising:

installing a first ride control circuit to the first carry end of the first lift cylinder, the first ride control circuit having a first accumulator, a first ride control conduit fluidly connected to the first carry end and having a first flow restriction element, and a first ride control accumulator valve fluidly connected to the first accumulator and the first ride control conduit and being operable to either block or allow fluid communication between the first carry end and the first accumulator through the first flow restriction element;

installing a second ride control circuit to the second carry end of the second lift cylinder, the second ride control circuit having a second accumulator, a second ride control conduit fluidly connected to the second carry end and having a second flow restriction element, and a second ride control accumulator valve fluidly connected to the second accumulator and the second ride control conduit and being operable to either block or allow fluid communication between the second carry end and the second accumulator through the second flow restriction element;

detecting an occurrence of a ride control trigger event; and opening the first ride control accumulator valve to allow fluid communication between the first carry end and the first accumulator through the first flow restriction element, and opening the second ride control accumulator valve to allow fluid communication between the second carry end and the second accumulator through the second flow restriction element, in response to detecting the occurrence of the ride control trigger event.

11. The method of damping machine bounce using the DCM assembly of claim 10, wherein the ride control trigger event occurs when a machine speed of the motor grader over a work surface is greater than a ride control threshold machine speed value.

12. The method of damping machine bounce using the DCM assembly of claim 10, wherein the ride control trigger event occurs when a ride control activation switch is set to a ride control active position.

13. The method of damping machine bounce using the DCM assembly of claim 10, wherein the first ride control circuit includes a first head end valve fluidly connected to the first head end, a first directional control circuit of the motor grader and a low pressure fluid reservoir, the first head end valve being operable to selectively fluidly connect the first head end to either the first directional control circuit or the low pressure fluid reservoir, and wherein the second ride control circuit includes a second head end valve fluidly connected to the second head end, a second directional control circuit of the motor grader and the low pressure fluid reservoir, the second head end valve being operable to selectively fluidly connect the second head end to either the second directional control circuit or the low pressure fluid reservoir, the method of damping bounce of the DCM assembly comprising operating the first head end valve to fluidly connect the first head end to the low pressure fluid reservoir, and operating the second head end valve to fluidly connect the second head end to the low pressure fluid reservoir, in response to detecting the occurrence of the ride control trigger event.

14. The method of damping machine bounce using the DCM assembly of claim 10, comprising:

closing the first ride control accumulator valve in response to detecting a first directional control circuit operating to place the first head end and the first carry end in fluid communication with a high pressure fluid conduit and a drain conduit; and closing the second ride control accumulator valve in response to detecting a second directional control circuit operating to place the second head end and the second carry end in fluid communication with the high pressure fluid conduit and the drain conduit.

15. A motor grader having ride control for dampening machine bounce using a drawbar-circle-moldboard (DCM) assembly rotatably coupled to and suspended from a frame of the motor grader, the motor grader comprising:

a first lift cylinder having a first head end connected to the frame and a first carry end connected to a first side of the DCM assembly;

a first directional control circuit fluidly connected to the first head end and the first carry end of the first lift cylinder and operable to selectively place the first head end and the first carry end in fluid communication with a high pressure fluid conduit and a drain conduit to extend the first lift cylinder and lower the first side of the DCM assembly, to retract the first lift cylinder and raise the first side of the DCM assembly, and to maintain the first lift cylinder in a fixed position;

a first accumulator;

a first ride control conduit fluidly connected to the first carry end and having a first flow restriction element;

a first ride control accumulator valve fluidly connected to the first accumulator and the first ride control conduit and being operable to either block or allow fluid communication between the first carry end and the first accumulator through the first flow restriction element; and a controller operatively connected to the first directional control circuit and the first ride control accumulator valve, the controller being programmed to:

detect an occurrence of a ride control trigger event; and in response to detecting the occurrence of the ride control trigger event, transmit ride control signals to the first ride control accumulator valve to cause the first ride control accumulator valve to open to allow fluid communication between the first carry end and the first accumulator through the first flow restriction element.

16. The motor grader of claim 15, comprising a machine speed sensor operatively connected to the controller and configured to detect a machine speed of the motor grader over a work surface and to transmit machine speed sensor signals having a machine speed sensor value corresponding to a detected machine speed, wherein, to determine the occurrence of the ride control trigger event, the controller is programmed to:

compare the machine speed sensor value from the machine speed sensor to a ride control threshold machine speed value; and transmit the ride control signals in response to determining that the machine speed sensor value is greater than the ride control threshold machine speed value.

17. The motor grader of claim 15, comprising a ride control activation switch operatively connected to the controller and configured to detect input of an operator of the motor grader to select a ride control active position or a ride control off position of the ride control activation switch and to transmit ride control activation switch signals having a ride control activation switch value corresponding to a ride control actuation switch input by the operator, wherein, to determine the occurrence of the ride control trigger event, the controller is programmed to:

determine whether the ride control activation switch value corresponds to the ride control active position; and transmit the ride control signals in response to determining that the ride control activation switch value corresponds to the ride control active position.

18. The motor grader of claim 15, wherein the first flow restriction element has a flow restriction element diameter that is within a range from 2.0 mm to 4.0 mm.

19. The motor grader of claim 15, wherein the first flow restriction element has a flow restriction element diameter that is approximately 3.0 mm.

20. The motor grader of claim 15, wherein the first flow restriction element has a flow restriction element diameter that is variable.

* * * * *